US008801487B2

(12) United States Patent
Wei et al.

(10) Patent No.: US 8,801,487 B2
(45) **Date of Patent: *Aug. 12, 2014**

(54) METHOD FOR MAKING EMITTER HAVING CARBON NANOTUBES

(71) Applicants: Tsinghua University, Beijing (CN); Hon Hai Precision Industry Co., Ltd., New Taipei (TW)

(72) Inventors: Yang Wei, Beijing (CN); Peng Liu, Beijing (CN); Liang Liu, Beijing (CN); Shou-Shan Fan, Beijing (CN)

(73) Assignees: Tsinghua University, Beijing (CN); Hon Hai Precision Industry Co., Ltd., New Taipei (TW)

( * ) Notice: Subject to any disclaimer, the term of this patent is extended or adjusted under 35 U.S.C. 154(b) by 0 days.

This patent is subject to a terminal disclaimer.

(21) Appl. No.: 13/792,524

(22) Filed: Mar. 11, 2013

(65) Prior Publication Data

US 2013/0203314 A1 Aug. 8, 2013

Related U.S. Application Data

(63) Continuation of application No. 12/384,243, filed on Apr. 2, 2009, now Pat. No. 8,421,327.

(30) Foreign Application Priority Data

Jun. 13, 2008 (CN) ..... 2008 1 0067726

(51) Int. Cl.
*H01J 9/00* (2006.01)
*H01J 9/04* (2006.01)

(52) U.S. Cl.
USPC ..... 445/50; 313/309; 313/311; 445/46; 445/49; 445/51

(58) Field of Classification Search
CPC ..... H01J 2329/04; H01J 2329/0455; H01J 2329/0439; H01J 1/304; H01J 9/02; H01J 9/025; H01J 31/127; H01J 2209/02
USPC ..... 445/50, 51; 313/309, 311
See application file for complete search history.

(56) References Cited

U.S. PATENT DOCUMENTS

| | | | | |
|---|---|---|---|---|
| 8,029,328 | B2 * | 10/2011 | Wei et al. | 445/50 |
| 8,371,892 | B2 * | 2/2013 | Wei et al. | 445/50 |
| 8,563,136 | B2 * | 10/2013 | Yang et al. | 428/408 |
| 8,597,990 | B2 * | 12/2013 | Li et al. | 438/151 |
| 2008/0248235 | A1 * | 10/2008 | Feng et al. | 428/113 |
| 2014/0027404 | A1 * | 1/2014 | Wei et al. | 216/7 |

* cited by examiner

*Primary Examiner* — Sikha Roy
(74) *Attorney, Agent, or Firm* — Novak Druce Connolly Bove + Quigg LLP

(57) ABSTRACT

A method for making an emitter is disclosed. A number of carbon nanotubes in parallel with each other are provided. The carbon nanotubes have a number of first ends and a number of second ends opposite to the number of first ends. The first ends are attached on a first electrode and the second ends are attached on a second electrode. The first electrode and the second electrode are spaced from each other. A voltage is supplied between the first electrode and the second electrode to break the carbon nanotubes.

20 Claims, 10 Drawing Sheets

METHOD FOR MAKING EMITTER HAVING CARBON NANOTUBES

RELATED APPLICATIONS

This application is a continuation application of U.S. patent application Ser. No. 12/384,243, filed on Apr. 2, 2009, and entitled, "EMITTER AND METHOD FOR MANUFACTURING SAME," which claims all benefits accruing under 35 U.S.C. §119 from China Patent Application No. 200810067726.1, filed on Jun. 13, 2008 in the China Intellectual Property Office, the contents of which are hereby incorporated by reference.

BACKGROUND

1. Technical Field

The present disclosure relates to an emitter and, in particularly, to an emitter employed with the carbon nanotubes and a method for manufacturing the same.

2. Description of the Related Art

Carbon nanotubes (CNTs) are widely used as field emitters for field emission displays (FEDs) and liquid crystal displays (LCDs). Such CNTs have good electron emission characteristics, and chemical and mechanical durability.

Conventional field emitters are typically micro tips made of a metal such as molybdenum (Mo). However, the life span of such a micro tip is shortened due to effects of atmospheric environment, such as non-uniform electric field, and the like. A somewhat viable alternative has been carbon nanotubes having a high aspect ratio, high durability, and high conductivity preferably adopted as field emitters.

In order to obtain a high current density from carbon nanotube emitters, carbon nanotubes must be uniformly distributed and arranged perpendicular to a substrate. The carbon nanotube emitters are generally grown from a substrate using a chemical vapor deposition (CVD). However, the carbon nanotubes formed by this process may be entangled with each other on the top thereof, which result in a poor morphology of CNTs and poor performance on emitting. Alternatively, the carbon nanotube emitters may also be manufactured by printing a paste obtained by combining carbon nanotubes with a resin to a substrate. This method is easier and less costly than CVD and thus preferred to CVD. However, the carbon nanotubes formed by this process are too dense to emit electrons effectively because of the strong screening effect generated between adjacent carbon nanotubes.

What is needed, therefore, is a carbon nanotube emitter and a method for manufacturing the same that can overcome the above-described shortcomings.

BRIEF DESCRIPTION OF THE DRAWINGS

The present emitter and method for manufacturing the same are described in detail hereinafter, by way of example and description of an exemplary embodiment and with references to the accompanying drawings, in which.

DETAILED DESCRIPTION

A detailed explanation of an emitter and method for manufacturing the same according to an exemplary embodiment will now be made with references to the drawings attached hereto.

Figure 1:
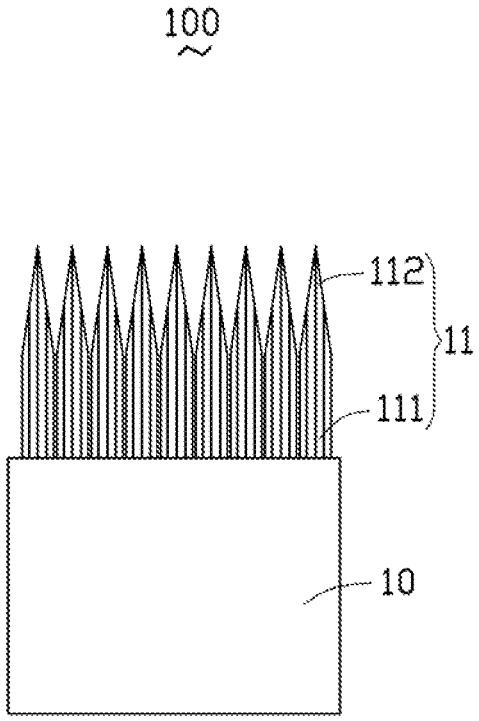
FIG. 1 is a schematic view of an emitter provided with a number of carbon nanotubes each having a needle-shaped tip according to an exemplary embodiment.
Figure 2:
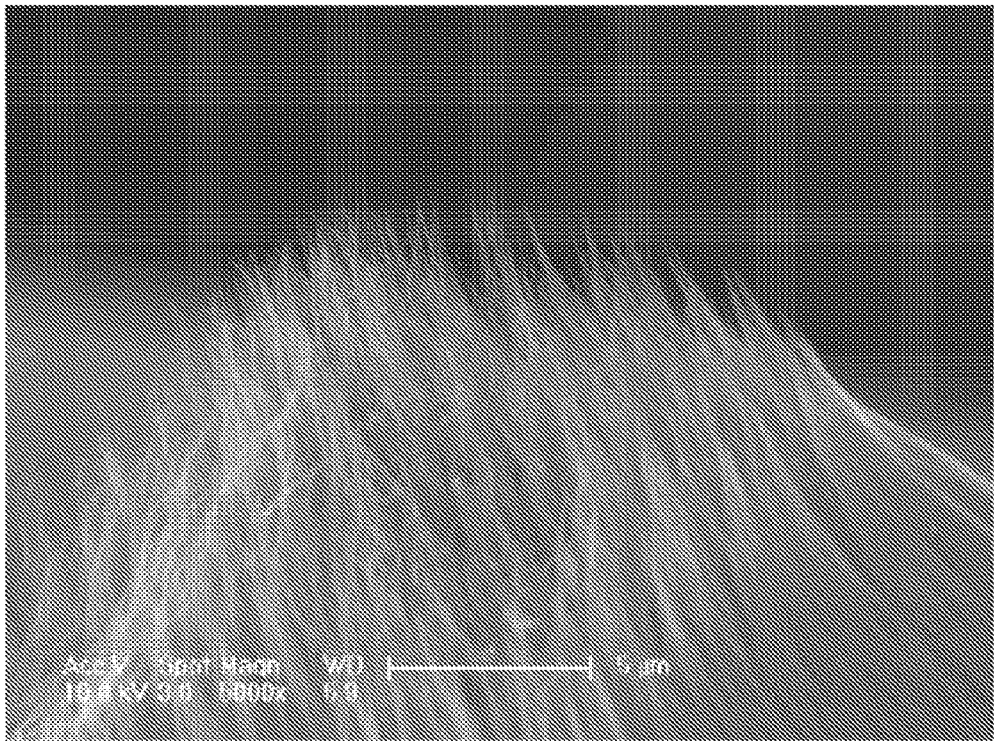
FIG. 2 is a scanning electron microscope (SEM) image of the carbon nanotubes of FIG. 1.
Figure 3:
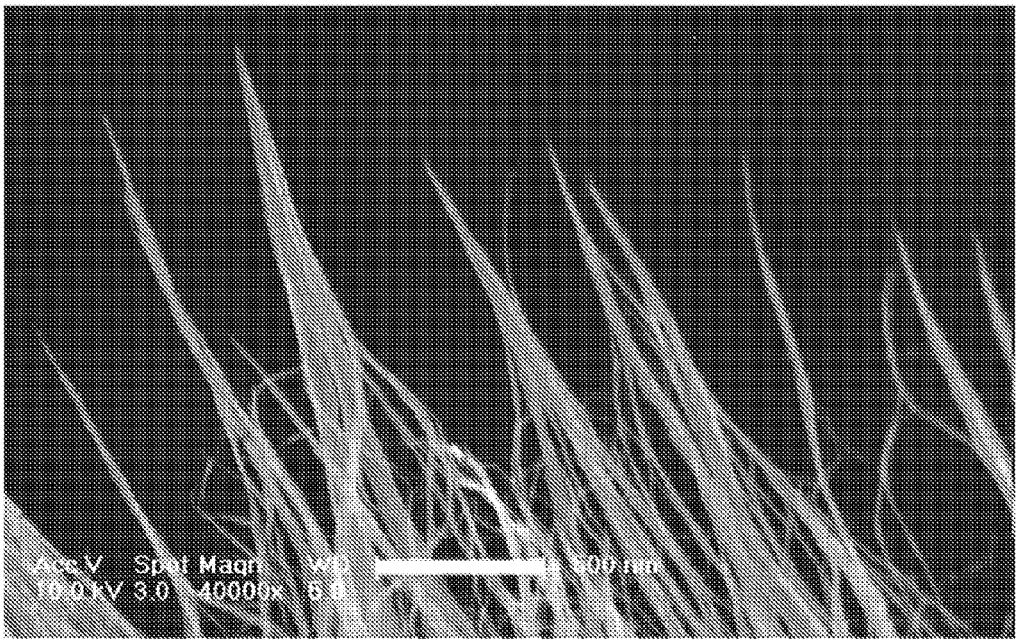
FIG. 3 is an SEM image of the needle-shaped tip of the carbon nanotubes of FIG. 1.

Referring to FIGS. 1-3, an emitter 100 according to the present embodiment is shown. The emitter 100 includes a substrate 10, and a number of carbon nanotubes 11 disposed on the substrate 10.

The substrate 10 may be an electrode made of copper, tungsten, aurum, gold, molybdenum, platinum, ITO glass, and combinations thereof. Alternatively, the substrate 10 may be an insulating substrate, such as a silicon sheet, coated with a metal film with a predetermined thickness. The metal film maybe one of an aluminum (Al) film, silver (Ag) film or the like. In the present embodiment, the substrate 10 is a silicon sheet coated with an Al film and configured for supporting and electrically connecting to the carbon nanotubes 11 and may function as a cathode of a field emission display (FED) (not shown). If necessary, a gate insulating layer and a gate electrode may be optionally formed on the conductive substrate 10.

The carbon nanotubes 11 may be conductive single-walled carbon nanotubes (SWCNT), double-walled carbon nanotubes (DWCNT), or multi-walled carbon nanotubes (MWCNT), or their mixture. The carbon nanotubes 11 are parallel to each other. Each of the carbon nanotubes 11 has the approximately same length and includes a first end 111 and a second end 112 opposite to the first end 111. The first end 111 is electrically connected to the conductive substrate 10 by Van der Waals Force. For enhancing a fastening force between the first end 111 and the conductive substrate 10, the first end 111 can be connected to the conductive substrate 10 via a conductive adhesive or by metal-bonding. The second end 112 extends away from the conductive substrate 10 and has a needle-shaped tip (not labeled). The needle-shaped tip is employed as an electron emitting source of the carbon nanotube emitter 100 for emitting electrons. The carbon nanotubes 11 each may have a diameter in a range from about 0.5 nm to about 50 nm and a length in a range about 100 μm to about 1 mm. The distance between the second ends 112 of the two adjacent carbon nanotubes 11 ranges from about 50 nm to about 500 nm. In the present embodiment, the carbon nanotubes 11 are SWCNTs having a diameter of about 1 nm and a length of about 150 mm. As shown in FIG. 3, two adjacent second ends 112 of carbon nanotubes 11 are spaced from each other by a distance greater than that between the first ends 111, thereby diminishing influence from the screening effect between the adjacent carbon nanotubes.

Figure 4:
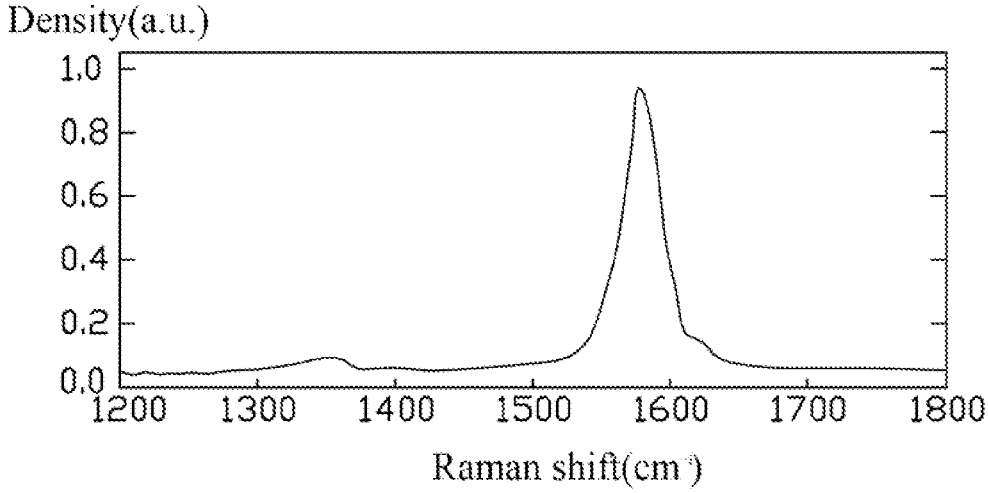
FIG. 4 is a Raman spectrum view of the emitter of FIG. 1.
Figure 5:
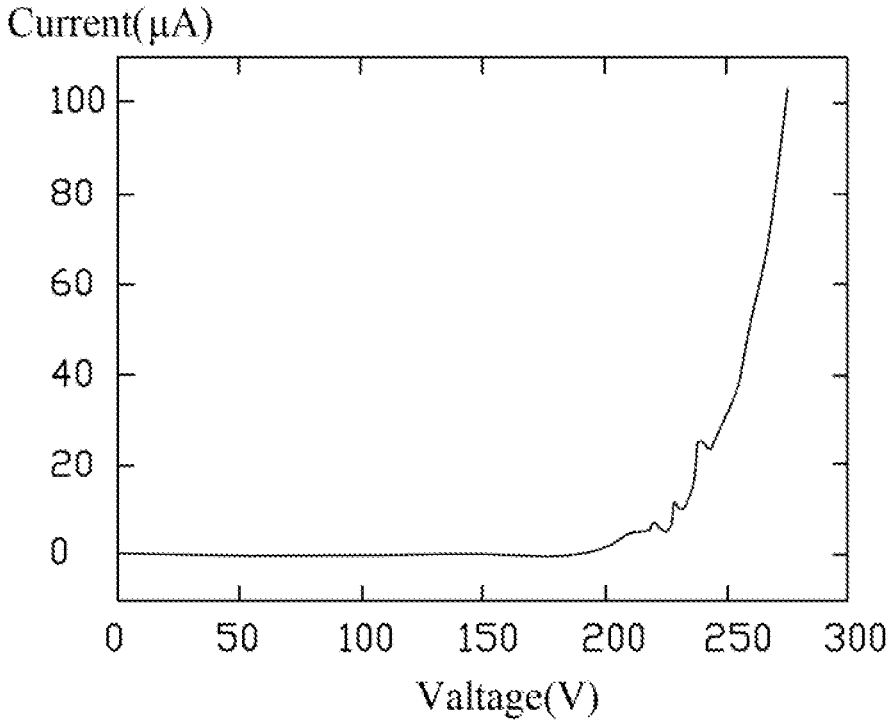
FIG. 5 is a voltage-current graph showing the electron emission characteristic of the emitter of FIG. 1.

Referring to FIGS. 4-5, in use, when the emitter 100 of the present embodiment is employed in the FED, the second end 112 can emit electrons when a low voltage is applied to the FED, because of the good electron emission characteristics of the needle-shaped tips. In the present embodiment, the emitter 100 starts to emit electrons when the applied voltage is about 200V or more. Understandably, as the applied voltage is increased, the current density increases accordingly. As shown in FIG. 4, defect analysis in Raman spectrum for the field emission affect of the carbon nanotubes 11 is shown. It can be seen that the carbon nanotubes 11 of the present embodiment have a lower defect peak than typical carbon nanotube. Therefore, it is possible to provide better field emission effect for the FED as desired.

Figure 6:
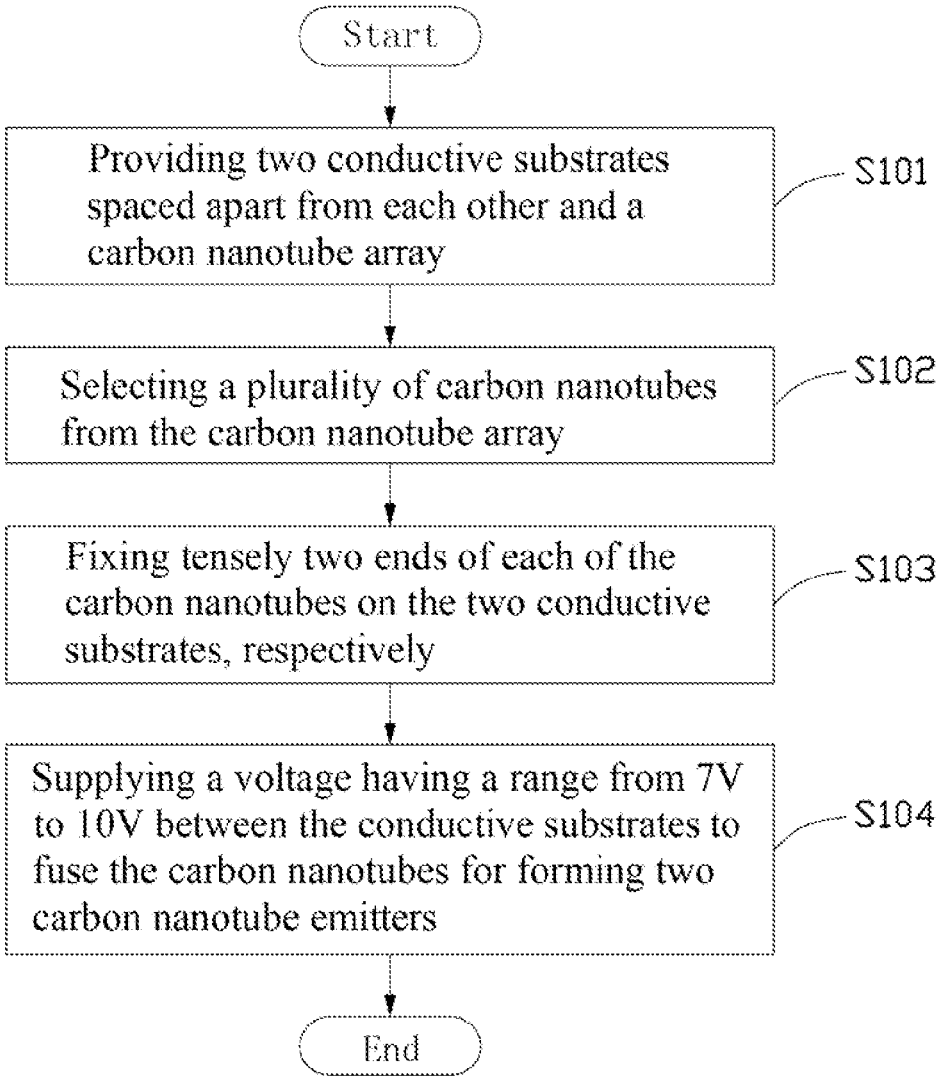
FIG. 6 is a flow chart of steps for manufacturing the emitter of FIG. 1.
Figure 7:
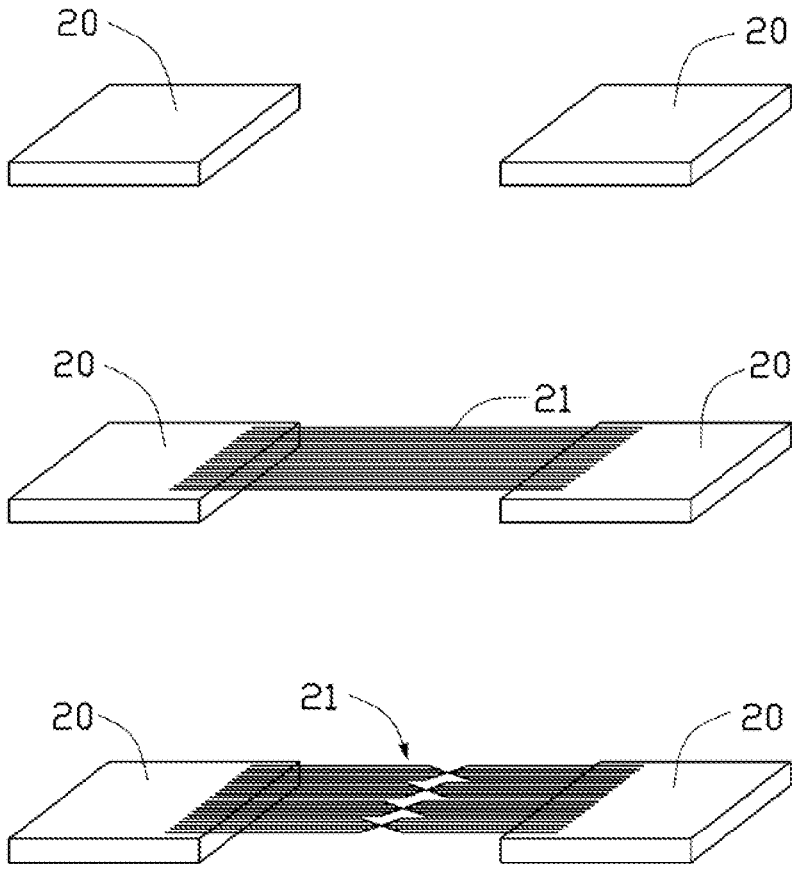
FIG. 7 is a schematic view of the manufactured emitter in steps of FIG. 6.

Referring to FIG. 6 and FIG. 7, a flow chart of an exemplary method for manufacturing the above-described emitter 100 is shown. The method includes:

step S101: providing two conductive substrates 20 spaced apart from each other and a carbon nanotube array (not shown);

step S102: selecting one or more carbon nanotubes 21 from the carbon nanotube array;

step S103: fixing each end of the one or more carbon nanotubes 21 on one of the two conductive substrates 20; and step S104: supplying a voltage sufficient to break the one or more carbon nanotubes 21 for forming two emitters 100.

Figure 8:
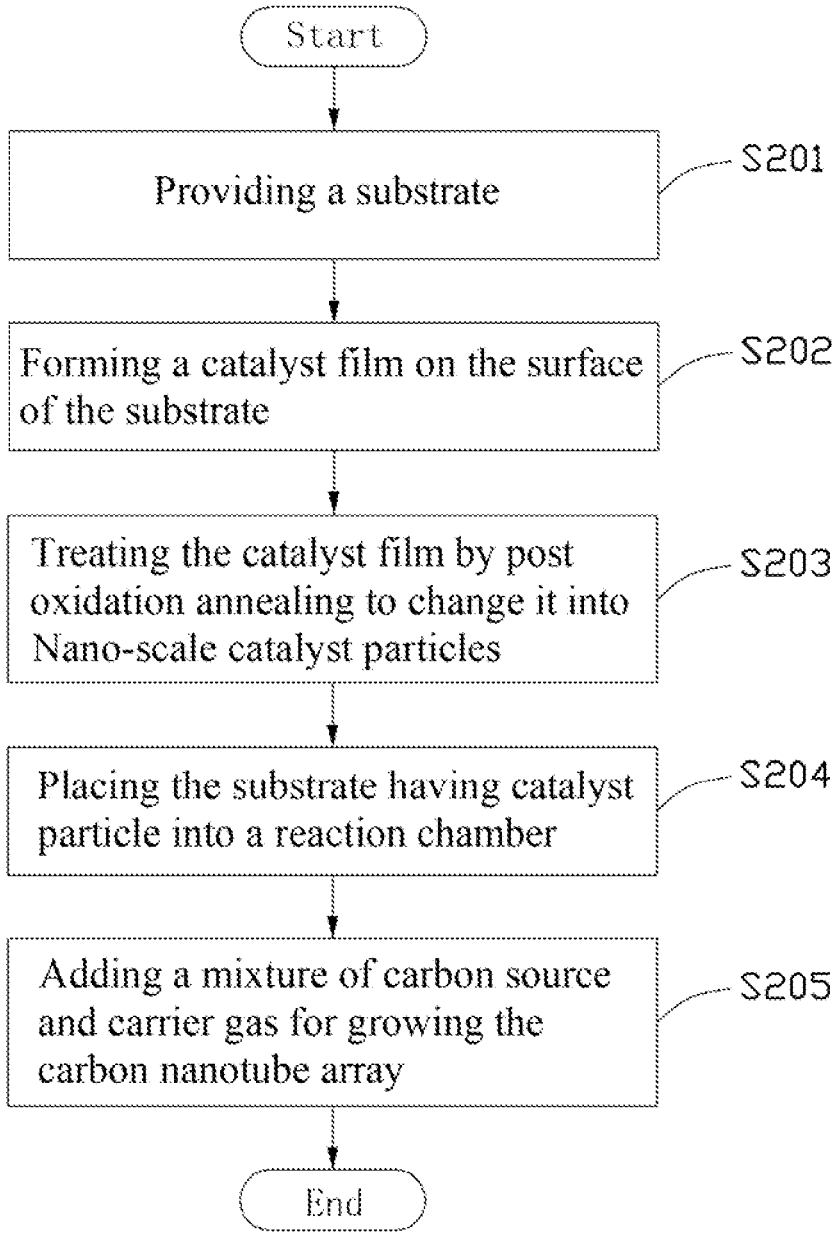
FIG. 8 is a flow chart of steps for growing a carbon nanotube array on a substrate.

In step S101, the carbon nanotube array may be acquired by the following method. The method may employ CVD, Arc-Evaporation Method, or Laser Ablation, but not limited to those methods. In the present embodiment, the method employs high temperature CVD. Referring also to FIG. 8, the method includes:

step S201: providing a substrate;

step S202: forming a catalyst film on the surface of the substrate;

step S203: treating the catalyst film by post oxidation annealing to change it into nano-scale catalyst particles;

step S204: placing the substrate having catalyst particles into a reaction chamber; and step S205: adding a mixture of a carbon source and a carrier gas for growing the carbon nanotube array.

In step S201, the substrate maybe a silicon wafer or a silicon wafer coated with a silicon oxide film on the surface thereof. In one embodiment, the silicon wafer has flatness less than 1 μm, for providing flat for the formed carbon nanotube array.

In step S203, the catalyst film may have a thickness in a range from about 1 nm to about 900 nm and the catalyst material may be Fe, Co, Ni, or the like.

In step S203, the treatment is carried out at temperatures ranging form about 500° C. to about 700° C. for anywhere from about 5 hours to about 15 hours.

In step S204, the reaction chamber is heated up to about 500° C. to about 700° C. and filled with protective gas, such as inert gas or nitrogen for maintaining purity of the carbon nanotube array.

In step S205, the carbon source may be acetylene, ethylene or the like, and have a velocity of about 20 sccm (Standard Cubic Centimeter per Minute) to about 50 sccm. The carrier gas may be insert gas or nitrogen, and have a velocity of about 200 sccm to about 500 sccm.

In step S102, the two conductive substrates 20 are spaced apart from each other to apply tension to the carbon nanotubes 21 selected from the carbon nanotube array. The distance between the two conductive substrates 20 is limited by the length of the carbon nanotubes.

Figure 9:
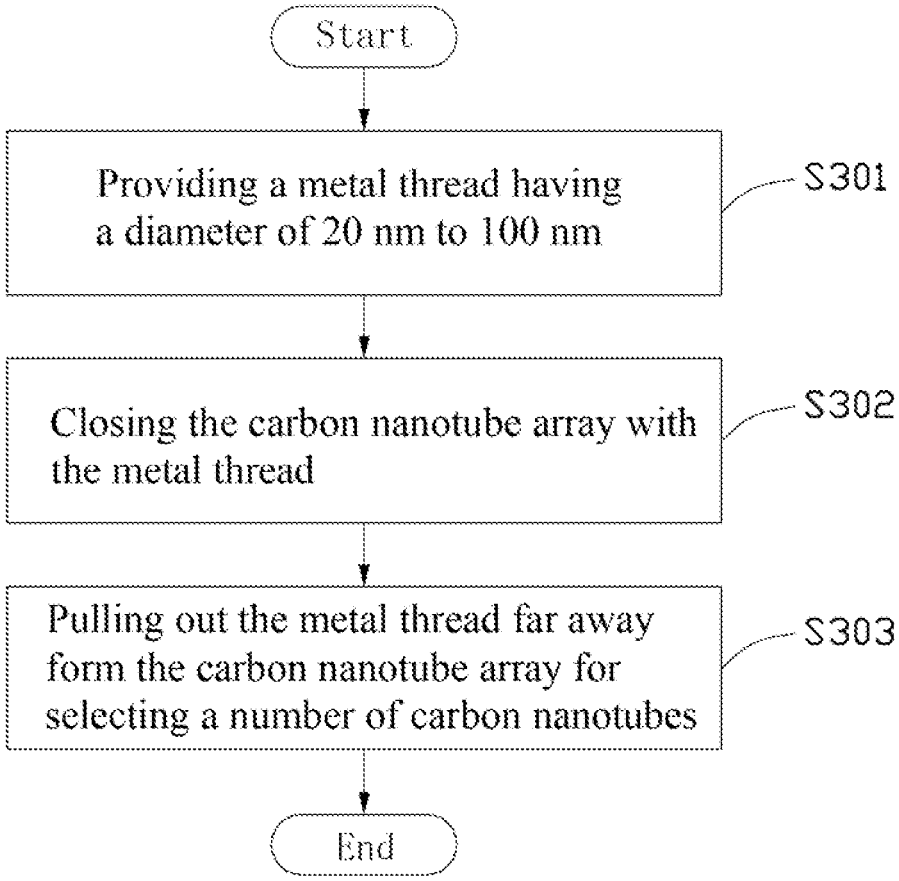
FIG. 9 is a flow chart of steps for selecting a number of carbon nanotubes from the carbon nanotube array of FIG. 8.
Figure 10:
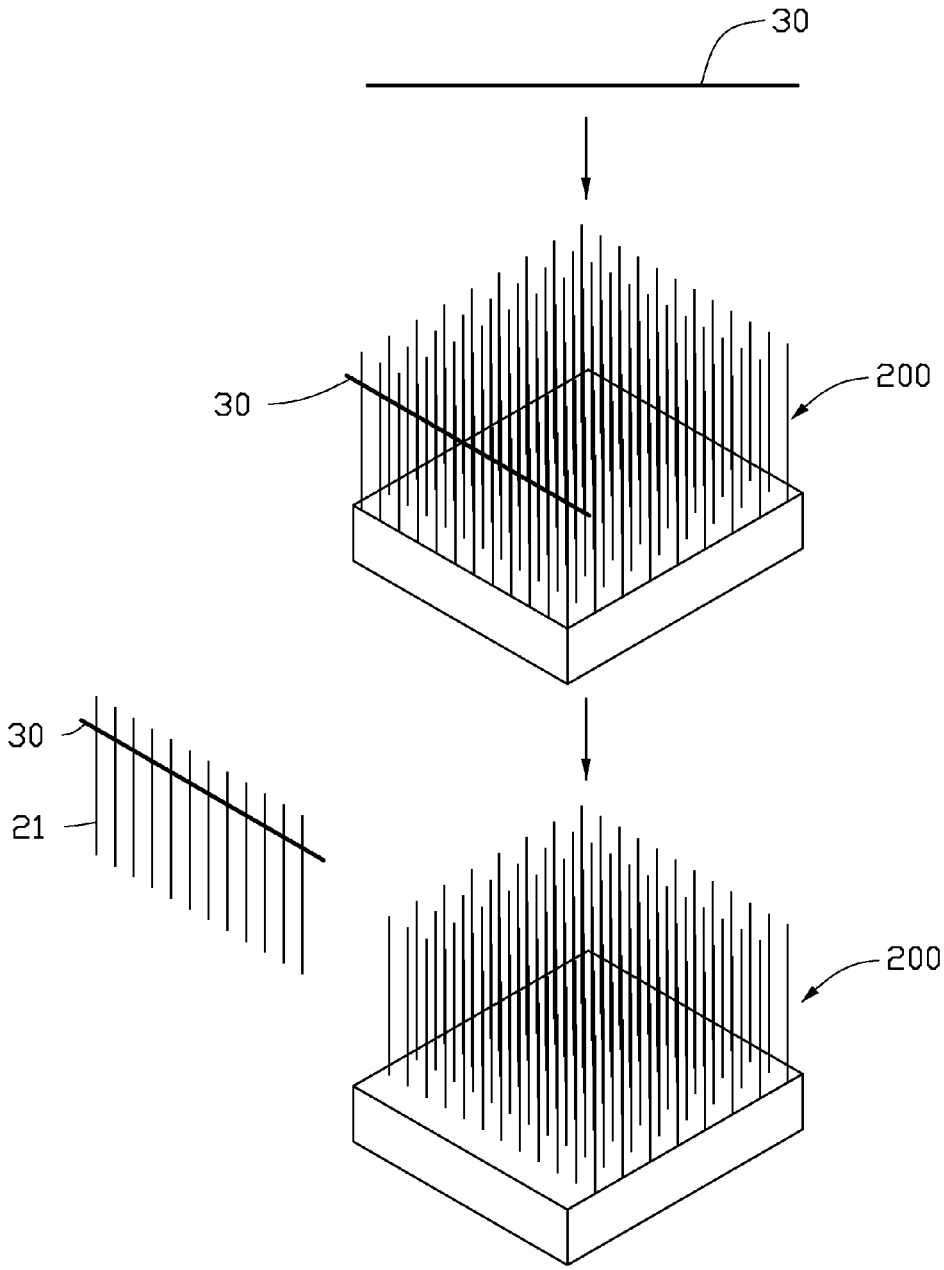
FIG. 10 is a flow chart of selecting a number of carbon nanotubes from the carbon nanotube array.

In step S103, the number of carbon nanotubes 21 are selected and drawn out from the carbon nanotube array provided in step S101 and opposite ends of the carbon nanotubes 21 are fixed onto the two conductive substrates 20, respectively. Referring to FIGS. 9-10, the method for selecting the carbon nanotubes 21 includes:

step S301: providing a metal thread 30 having a diameter of about 20 nm to about 100 nm;

step S302: bringing the metal thread 30 towards the carbon nanotube array 200 and contacting the carbon nanotube array 200;

step S303: pulling out the metal thread 30 away from the carbon nanotube array 200 for obtaining a number of carbon nanotubes 21.

In described method above, the metal may be copper, silver, and gold, or an alloy thereof. In the step S302, because of the strong molecular force between the carbon nanotube and the metal thread 30, some carbon nanotubes 21 can be adsorbed onto the metal thread 30. In step S303, a single segment of carbon nanotubes 21 is acquired. In the present embodiment, the acquired carbon nanotubes 21 have a length of about 2 μm to about 200 μm.

In step S104, the two conductive substrates 20 and the carbon nanotubes 21 are placed into a reaction chamber (not shown) for ensuring purity of the obtained carbon nanotubes 21 before supplying the voltage on the carbon nanotubes. The reaction chamber may be a vacuum chamber having pressure intensity less than 1×10-1 Pa or is filled with inert gas or nitrogen to prevent the carbon nanotubes 21 from oxidizing during breaking. In the present embodiment, the reaction chamber is a vacuum chamber having a pressure intensity of $2\times10^{-5}$ Pa. As well known in the art, the voltage applied between the two conductive substrates 20 is determined according to the dimension of the carbon nanotubes 21. The supplied voltage may have a range from about 7V to about 10V. In the present embodiment, the applied voltage is 8.25V. When the current flows through the carbon nanotubes 21, heat, known as joule heat, can be generated. The joule heat can break the carbon nanotubes 21. After breaking, the current is turned off and the joule heat disappears quickly, thus annealing the formed carbon nanotubes 11. The anneal, which is advantageous for improving mechanical strength of the carbon nanotubes 11, can be carried out in a vacuum chamber for preventing the carbon nanotubes 11 from oxidizing. Thus, two emitters 100 are obtained. The obtained emitters 100 have an approximately as many second ends 112 each having a needle-shaped tip as there are carbon nanotubes.

The described method above for manufacturing the carbon nanotubes 11 of the emitter 100 can prevent pollutant from entering the carbon nanotubes 11 as the second ends 112 are closed and have a substantially uniform length, which can provide substantially uniform electron emitting characteristics. Moreover, the second ends 112 of the two adjacent carbon nanotubes 11 are spaced from each other by a distance greater than that of the first ends 111, thereby diminishing influence from the screening effect between adjacent carbon nanotubes.

It is to be understood that the above-described embodiments are intended to illustrates, rather than limit the disclosure. Variations may be made to the embodiments without departing from the spirit of the disclosure as claimed. The above-described embodiments illustrate the scope of the disclosure but do not restrict the scope of the disclosure.

It is to be understood that the above description and the claims drawn t a method may include some indication in reference to certain steps. However, the indication used is only to be viewed for identification purposes and not as a suggestion as to an order for the steps.

What is claimed is:

1. A method for making an emitter, comprising:

selecting one or more carbon nanotubes from a carbon nanotube array;

fixing each end of the one or more carbon nanotubes on one of two electrodes, wherein the two electrodes are spaced from each other; and supplying a voltage between the two electrodes to break the one or more carbon nanotubes.

2. The method of claim 1, wherein the selecting one or more carbon nanotubes from a carbon nanotube array comprises:

contacting a metal thread with the carbon nanotube array; and pulling the metal thread away from the carbon nanotube array.

3. The method of claim 2, wherein a diameter of the metal thread is in a range from about 20 nanometers to about 100 nanometers.

4. The method of claim 1, wherein the supplying the voltage between the two electrodes comprises placing the two electrodes with the one or more carbon nanotubes attached into a reaction chamber.

5. The method of claim 4, wherein the reaction chamber is under a vacuum.

6. The method of claim 4, wherein the reaction chamber is filled with a noble gas selected from the group consisting of helium, argon, and neon.

7. The method of claim 1, wherein the voltage is in a range from about 7V to about 10V.

8. A method for making an emitter, comprising:

providing a plurality of carbon nanotubes in parallel with each other, wherein the plurality of carbon nanotubes has a plurality of first ends and a plurality of second ends opposite to the plurality of first ends;

attaching the plurality of first ends on a first electrode and attaching the plurality of second ends on a second electrode, wherein the first electrode and the second electrode are spaced from each other; and supplying a voltage between the first electrode and the second electrode to break the plurality of carbon nanotubes.

9. The method of claim 8, wherein the providing the plurality of carbon nanotubes comprises drawing the plurality of carbon nanotubes out from a carbon nanotube array.

10. The method of claim 9, wherein the drawing the plurality of carbon nanotubes out from the carbon nanotube array comprises:

contacting a metal thread with the carbon nanotube array; and pulling out the metal thread away from the carbon nanotube array.

11. The method of claim 10, wherein a diameter of the metal thread is in a range from about 20 nanometers to about 100 nanometers.

12. The method of claim 8, wherein the supplying the voltage between the first electrode and the second electrode comprises placing the first electrode, the second electrode and the plurality of carbon nanotubes into a reaction chamber.

13. The method of claim 12, wherein the reaction chamber is under a vacuum.

14. The method of claim 12, wherein the reaction chamber is filled with a noble gas selected from the group consisting of helium, argon, and neon.

15. The method of claim 8, wherein the voltage is in a range from about 7V to about 10V.

16. A method for making an emitter, comprising:

drawing a carbon nanotube segment from a carbon nanotube array, wherein the carbon nanotube segment comprises a plurality of carbon nanotubes in parallel with each other;

placing the carbon nanotube segment on two electrodes, wherein the two electrodes are spaced from each other and portion of the carbon nanotube segment is suspended between the two electrodes; and supplying a current through the carbon nanotube segment to break the carbon nanotube segment.

17. The method of claim 16, wherein the placing the carbon nanotube segment on the two electrodes comprises extending the plurality of carbon nanotubes from one of the two electrodes to the other one.

18. The method of claim 16, wherein the supplying the current through the carbon nanotube segment comprises placing the two electrodes with the carbon nanotube segment into a reaction chamber.

19. The method of claim 18, wherein the reaction chamber is under a vacuum.

20. The method of claim 18, wherein the reaction chamber is filled with a noble gas.

* * * * *